US011198268B2

(12) United States Patent
Desertot

(10) Patent No.: US 11,198,268 B2
(45) Date of Patent: Dec. 14, 2021

(54) DEVICE AND METHOD FOR REMOVING A BOX FROM A CHUCK

(71) Applicant: DS SMITH PACKAGING FRANCE, Puteaux (FR)

(72) Inventor: Didier Desertot, Arc-sur-Tille (FR)

(73) Assignee: DS Smith Packaging France, Puteaux (FR)

( * ) Notice: Subject to any disclaimer, the term of this patent is extended or adjusted under 35 U.S.C. 154(b) by 233 days.

(21) Appl. No.: 16/340,911

(22) PCT Filed: Oct. 9, 2017

(86) PCT No.: PCT/FR2017/052762

§ 371 (c)(1),
(2) Date: Apr. 10, 2019

(87) PCT Pub. No.: WO2018/069618

PCT Pub. Date: Apr. 19, 2018

(65) Prior Publication Data

US 2019/0283356 A1 Sep. 19, 2019

(30) Foreign Application Priority Data

Oct. 11, 2016 (FR) ..... 1659831

(51) Int. Cl.
*B31B 50/00* (2017.01)
*B31B 50/28* (2017.01)
(Continued)

(52) U.S. Cl.
CPC ..... *B31B 50/282* (2017.08); *B31B 50/00* (2017.08); *B31B 50/06* (2017.08); *B31B 50/07* (2017.08);
(Continued)

(58) Field of Classification Search
CPC ..... B31B 50/00; B31B 50/06; B31B 50/07; B31B 50/28; B31B 50/282;
(Continued)

(56) References Cited

U.S. PATENT DOCUMENTS 2,515,621 A 7/1950 Wilbrandt
9,821,527 B2 * 11/2017 Hagelqvist ..... B29C 65/3684
(Continued)

FOREIGN PATENT DOCUMENTS

CH 345236 A 3/1960
FR 0334707 A1 9/1989
(Continued)

OTHER PUBLICATIONS

International Search Report and Written Opinion for PCT/FR2017/052762 dated Jan. 5, 2018. [English Translation Provided].

*Primary Examiner* — Chelsea E Stinson
(74) *Attorney, Agent, or Firm* — Thomas|Horstemeyer LLP

(57) ABSTRACT

The present invention relates to a device for removing a box or box part with a polygonal section from a chuck (51) comprising an upper face (511), an application face (510) interconnected by lateral faces and an end face (514), a chuck whereon the box has been previously formed from a blank (1). It comprises a plate (64) comprising first gripping means and translatably movable between a deployed position wherein the plate is near the end face (514) of the chuck whereon the lateral flaps (16*a* to 16*d*) are intended to be folded and folded position wherein the plate (64) is away from the chuck (51). The chuck (51) itself is movable between a first forming position wherein the outer cross-section thereof corresponds to the inner cross-section of the box or box part and a second retracted position wherein the
(Continued)

outer cross-section thereof is smaller than the inner cross-section of the box or box part.

12 Claims, 10 Drawing Sheets

(51) Int. Cl.
*B31B 50/07* (2017.01)
*B31B 100/00* (2017.01)
*B31B 50/06* (2017.01)
*B31B 110/30* (2017.01)

(52) U.S. Cl.
CPC ..... *B31B 50/28* (2017.08); *B31B 2100/0022* (2017.08); *B31B 2110/30* (2017.08)

(58) Field of Classification Search
CPC ..... B31B 2100/00; B31B 21/0022; B31B 2110/00; B31B 2110/30; B31B 2105/0022
See application file for complete search history.

(56) References Cited

U.S. PATENT DOCUMENTS

2007/0037682 A1* 2/2007 Scholtes ..... B31B 50/00 493/175
2009/0291815 A1* 11/2009 Cavallari ..... B31B 50/00 493/173
2011/0166007 A1* 7/2011 Langen ..... B65D 5/20 493/127

FOREIGN PATENT DOCUMENTS

FR 2770446 A1 5/1999
FR 2829421 A1 3/2003

* cited by examiner 60
61
642
64
631
63
50
511
51
16a
512
16c
4
13
510

51
16a
63
64
16c
631
4
13
643

51
64
643
631

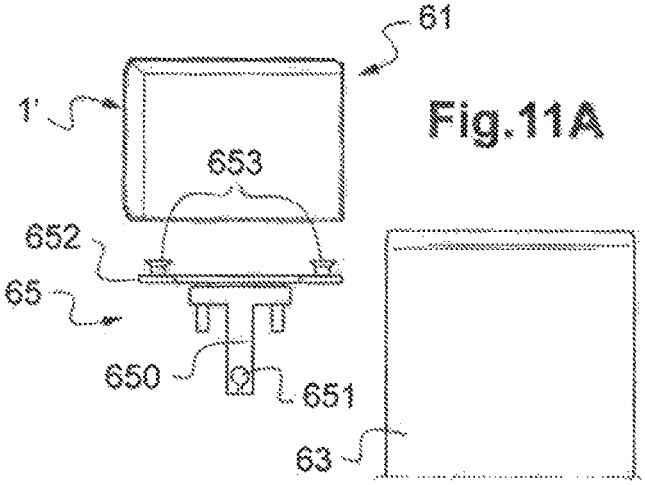
Fig.11A
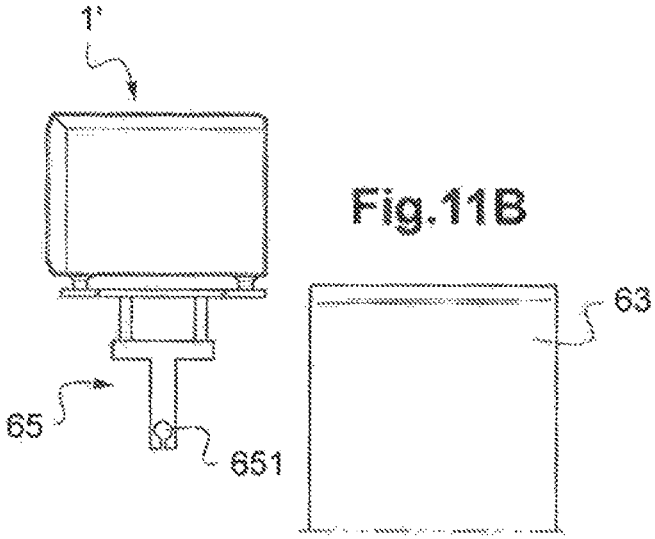
Fig.11B
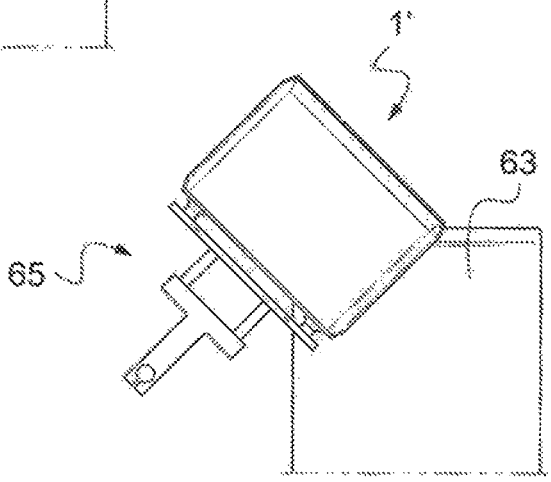
Fig.11C
Fig.11D
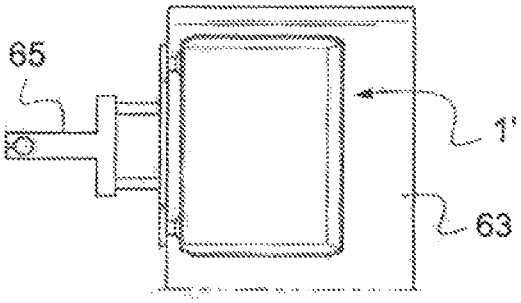

DEVICE AND METHOD FOR REMOVING A BOX FROM A CHUCK

CROSS-REFERENCE TO RELATED APPLICATIONS

This application is the 35 U.S.C. § 371 national stage application of PCT Application No. PCT/FR2017/052762, filed Oct. 9, 2017, where the PCT claims the priority to and benefit of French Patent Application No. 1659831, filed Oct. 11, 2016, both of which are herein incorporated by reference in their entireties.

The present invention relates to a device for removing a box or box part with a polygonal section from a chuck whereon the box has been previously formed from a blank made of sheet material.

The invention also relates to a method for removing a box or box part with a polygonal section from a chuck.

Such a blank made of sheet material conventionally comprises a series of at least three panels, i.e. two end panels situated on either side of at least one intermediate panel, said panels being interconnected by parallel folding lines and provided with lateral flaps, respectively connected to said panels by folding lines perpendicular to the folding lines connecting said panels, the free edge of one of the end panels being provided with a tongue connected to said end panel by a folding line parallel to the folding lines connecting said panels.

When the blank comprises three panels, it makes it possible to obtain a part of a box (lid or bottom). When same comprises at least four panels, it makes it possible to obtain a box.

In order to make it possible to obtain a box or box part, an adhesive is deposited on one hand, on two lateral flaps and on the other hand, on said tongue of an end panel or near the free edge of the end panel opposite said tongue.

Subsequently, the panels are wound about a chuck with a polygonal section the outer cross-section of which corresponds to the inner cross-section of the box or box part to be obtained, the tongue is attached against the free edge of the other end panel pressing against the upper face of the chuck, and the flaps being located on the same side as said panels and some of which comprise an adhesive are folded against a corresponding end face of the chuck then mutually attached.

The box or box part thus formed is subsequently removed from the chuck in order to carry out in particular the filling thereof, the marking thereof or any other action.

This invention finds a particularly important although not exclusive application in the field of reinforced corrugated cardboard boxes.

Numerous methods and devices for removing a box with a polygonal section from a chuck are already known.

In particular, document EP 0 334 707 can be cited, which describes a method and device consisting of successively taking the blanks in a magazine and depositing same on a table provided with drive fingers. Said drive fingers cause the blank to slide over the table to bring same under the chuck. During the transfer to the chuck, the blank meets the glue applicators arranged above and below the table that deposit lines of adhesive on the blank.

The forming of the blank about the chuck, the attachment of the tongue and the formation of the bottom of the box is provided using a plurality of actuators.

Once the box has been formed, same is ejected from the chuck by acting on a jack that may move a transverse plate, arranged within the chuck and serving as end face thereof.

Under the action of the jack, the box tips by passing on to a first conveyor, then a second conveyor situated at a lower level. The box is therefore removed by said second conveyor, whereon the box rests by the bottom thereof.

Numerous embodiments of said device have been proposed and globally provide satisfaction.

Nevertheless, said devices have drawbacks because the fact of allowing the box to fall does not make it possible to provide, in all cases, a correct positioning thereof. Moreover, this generally subsequently requires a recovery of the box by suitable means, which interrupts the cycle for treating the box and limits the rates that may be obtained.

The aim of the invention is to overcome said drawbacks by proposing a device and a method for removing a box or box part with a polygonal section from a chuck making it possible to perform said removal continuously and with significant accuracy, whilst being of a simple design and/or implementation.

In this aim, the invention proposes in particular a device for removing a box or box part with a polygonal section from a chuck comprising an upper face, a lower face connected by lateral faces and an end face, a chuck whereon the box has been previously formed from a blank comprising a series of at least three panels, i.e. two end panels on either side of at least one intermediate panel, said panels being interconnected by parallel folding lines and provided with lateral flaps, respectively connected to said panels by folding lines perpendicular to the folding lines connecting said panels, characterised in that it comprises a plate comprising first gripping means and translatably moveable between a deployed position wherein the plate is near the end face of the chuck whereon the lateral flaps are intended to be folded and a folded position wherein the plate is away from the chuck and in that the chuck itself is moveable between a first forming position wherein the outer cross-section thereof corresponds to the inner cross-section of the box or box part and a second retracted position wherein the outer cross-section thereof is smaller than the inner cross-section of the box or box part.

By face of the chuck, it is understood a plane delimited by the end edges thereof, for example, formed by corner stays, without said face necessarily being solid and/or formed by a surface plate equal to same of said face.

Similarly, by plate (comprising gripping means), it is understood a surface element extending over a surface area equal at least to one proportion of the surface area of a lateral flap suitable for forming the bottom of the box or box part.

A box part is in particular the lid or the bottom of a box.

In advantageous embodiments, moreover and/or in addition one and/or the other of the following arrangements are used:

- the device comprises an articulated arm system that may be deployed in a direction substantially perpendicular to said end face of the chuck and a first end of which is rigidly connected to the frame of the device and a second end of which supports said plate;
- said plate is rotatable between a flattened position wherein it is substantially parallel to the application face of the chuck and an upright position wherein same is substantially parallel to said end face;
- the first gripping means comprise suction means;
- when the chuck is in the first retracted position thereof, the distance between the upper face and the application face of the chuck is arranged to be smaller than the width of the box or box part;

the articulated arm system is rotatable about a vertical axis passing through the first end thereof rigidly connected to the frame.

The invention also relates to a method for removing a box or box part with a polygonal section from a chuck, the box or box part resulting from the forming about said chuck of a blank comprising a series of at least three panels, i.e. two end panels on either side of at least one intermediate panel, said panels being interconnected by parallel folding lines and provided with lateral flaps, respectively connected to said panels by folding lines perpendicular to the folding lines connecting said panels, said blank having previously been glued at least at the level of two lateral flaps and brought under the chuck, which is in a first forming position wherein the panels have been wound about the chuck, characterised in that it comprises the following steps:

applying a pressing force on an end face of the chuck whereon lateral flaps have previously been folded, for mutually attaching the flaps and forming the bottom of the box or box part the inner surface of which is in contact with the chuck, grasping by suction the bottom of the box or box part thus formed, reducing the outer section of the chuck and exerting on the outer surface of the bottom a drawing force perpendicular to the end face, by releasing the pressure on the bottom of the box or box part, in order to extract said box or box part from the chuck.

Advantageously, moreover and/or in addition one and/or the other of the following arrangements are used:

after removing the box or box part from the chuck, said box or box part is set back upright vertically and same is transferred to an evacuation station;

the box or box part is removed and set back upright by the same means;

said means also contribute to the transfer of the box or box part to an evacuation station;

said means also make it possible to fold down at least one of said flaps on said lateral face of the chuck.

The invention also relates to a machine for forming a box or box part with a polygonal section from a blank comprising a series of at least three panels, i.e. two end panels on either side of at least two intermediate panels, said panels being interconnected by parallel folding lines and provided with lateral flaps, respectively connected to said panels by folding lines perpendicular to the folding lines connecting said panels, comprising:

a gluing station wherein an adhesive is deposited on at least two lateral flaps, a forming station wherein the panels are wound about the chuck and flaps being located on the same side of said panels are folded and a removal station comprising a device such as previously described.

Advantageously, moreover and/or in addition one and/or the other of the following arrangements are used:

the machine also comprises a transfer station to at least one evacuation station;

the transfer station comprises second means for gripping the box or box part present at the removal station, said second means being rotatable between a first position wherein same are opposite the removal station and a second position wherein same are opposite the evacuation station, said second gripping means also being translatably moveable between a deployed position wherein same are intended to be in contact with the box or box part and a retracted position of rest;

the evacuation station comprises gripping means translatably moveable between a retracted position and a deployed position;

the second gripping means comprise suction means.

The invention also relates to a method for forming a box or box part with a polygonal section, from a blank comprising a set of three panels, interconnected by parallel folding lines and provided with lateral flaps, respectively connected to said panels by folding lines perpendicular to the folding lines connecting said panels, wherein:

the blank is glued at least at the level of two lateral flaps and brought under a chuck, the blank is subsequently formed about the chuck to obtain a box or box part, said box or box part is removed from the chuck by implementing the method such as previously described, said box or box part being subsequently transferred to an evacuation station.

The invention will be better understood and the advantages thereof will become more apparent upon reading the following description of embodiments given by way of non-limiting examples. The description refers to the drawings that accompany same wherein:

FIGS. 11A to 11G are top views illustrating the various steps for transferring and evacuating the box, after the removal thereof.

The elements common to the various figures will be designated by the same references.

Figure 1:
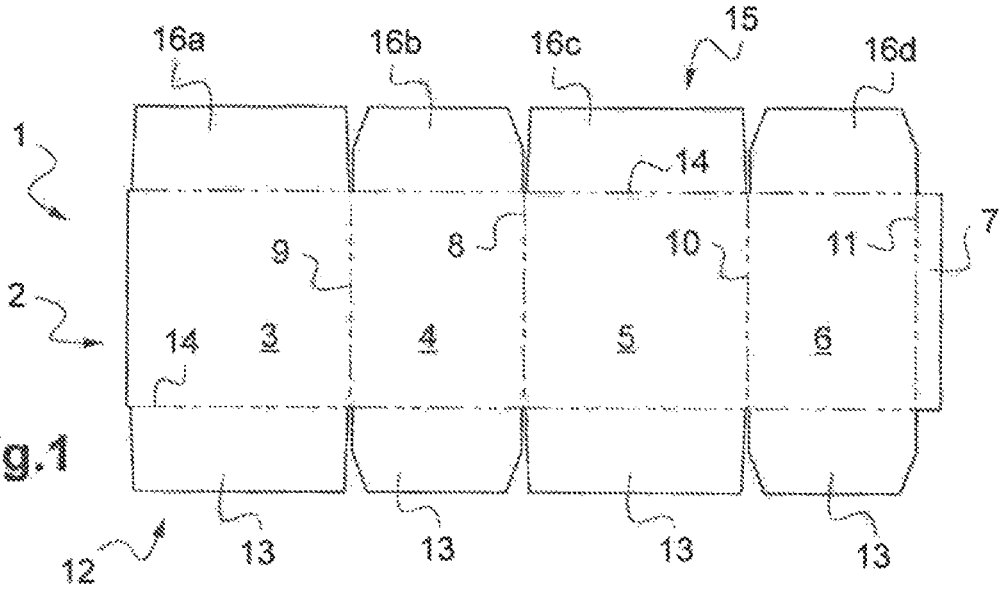
FIG. 1 shows in top view one embodiment of a blank that can be used with the method and the device for gluing according to the invention.

FIG. 1 shows a blank 1 made of double-sided corrugated cardboard, for example with low grammage (<250 g/m2) for example 3 mm thick for forming a box.

The blank comprises a series 2 of four main rectangular panels 3, 4, 5, 6 ended by a gluing tongue 7 and mutually folded by first folding lines, mutually parallel, i.e. a first central folding line or reference 8, two first lateral folding lines 9 and 10, and a first end folding line 11, for joining with the tongue 7.

The panels 3 and 6 are known as end panels and the panels 4 and 5, intermediate panels.

The blank comprises in a manner which is known per se a first set 12 of rectangular or substantially rectangular flaps 13 connected to the main panels by second folding lines 14 perpendicular to the first and suitable for forming the top of the box after filling and a second set 15 of rectangular or substantially rectangular flaps 16*a* to 16*d* also connected to the main panels by second folding lines 14 and suitable for forming the bottom of the box.

The method and the device according to the invention may also use embodiments of the blank illustrated in FIG. 1 and in particular a blank comprising rectangular main panels interconnected by rectangular intermediate panels.

In a manner known per se, said intermediate panels form, on the final box, the bevelled angles of said latter.

They may also use blanks comprising one intermediate panel and two end panels to obtain a box part.

First of all, reference is made to FIGS. 2 to 5 to describe a machine for forming a box or box part with a polygonal section from the blank illustrated in FIG. 1, said machine comprising a gluing device according to the invention more specifically described herein, in particular with reference to the other figures.

Said machine 20 comprises a frame or structure 21 forming a platform supporting sub-assemblies or independent modules, assembled to provide the formation of a box from the blank illustrated in FIG. 1.

This is the module 30 for storing-unstacking blanks, the module 40 for gluing blanks, the forming module 50, and the removal module 60.

Said modules may be manufactured independently and subsequently mounted on the frame 22.

Thus, the frame 21 provides the connection between the two end modules, i.e. the storage-unstacking module 30 and the removal module 60.

In the posts 22 of the frame, may be provided an electric cabinet that comprises a programmable logic controller for controlling the machine, known as per se.

The first storage-unstacking module 30 comprises a magazine 31 for storing in semi-vertical position the blanks 1 to be formed.

Same comprises two modular chains 32 driven by a system 33, comprising, for example, an asynchronous motor.

The chains 32 are for example coupled to a free wheel 34 and make it possible to maintain a blank ready to be fed in the front proportion 36.

In the storage magazine 31, the blanks are stored with the printed face turned towards the exterior of the machine and the tongue of the blank situated on the right side of the machine in the direction of travel of the blanks.

Said module 30 also comprises means 35 (see FIG. 3) for unstacking blanks 1 from the magazine 31.

The gluing module 40 comprises a gluing device with a flat support 41, such as a table, for receiving a blank 1. Along the longitudinal edges of said table 41, are provided fixed cleats 410 in relation to the table, making it possible to provide the positioning of the blank.

The gluing device also comprises an articulated arm system 42 supporting a nozzle 420 positioned above the support.

The forming module 50 comprises a chuck 51, that is to say a forming tool, whereabout the blank previously glued by the gluing device will be formed.

In order to move the blank 1 from the gluing device up to under the chuck 51, are provided transfer means 43 comprising an articulated arm system, situated under the table 41 and that may grasp from below a blank by suction means.

The forming module 50 (see FIG. 4) comprises, for its part, two cradles 52, 53, rigidly connected to the frame 21 and arranged on either side of the chuck 51, transversally and in a symmetrical manner in relation to the direction of feed of the blank from the gluing station.

Said cradles comprise, in the example illustrated in FIGS. 2 to 5, the means for winding the panels and the means for attaching the tongue.

The removal module 60 comprises a removal station for removing a box or box part with a polygonal section from the chuck 51 where the box was formed, thanks to a removal device 61, an evacuation station comprising the two conveyors 62, 63 as well as a station for transferring from the removal station to the evacuation station.

The removal device will now be described in greater detail with reference to FIGS. 6 to 9.

Figure 6:
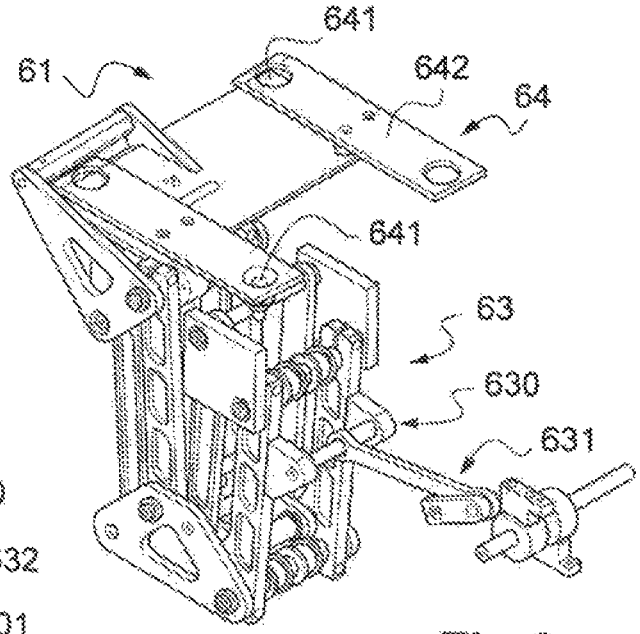
FIG. 6 is a rear perspective view of an example of removal device according to the invention, in retracted position.
Figure 7:
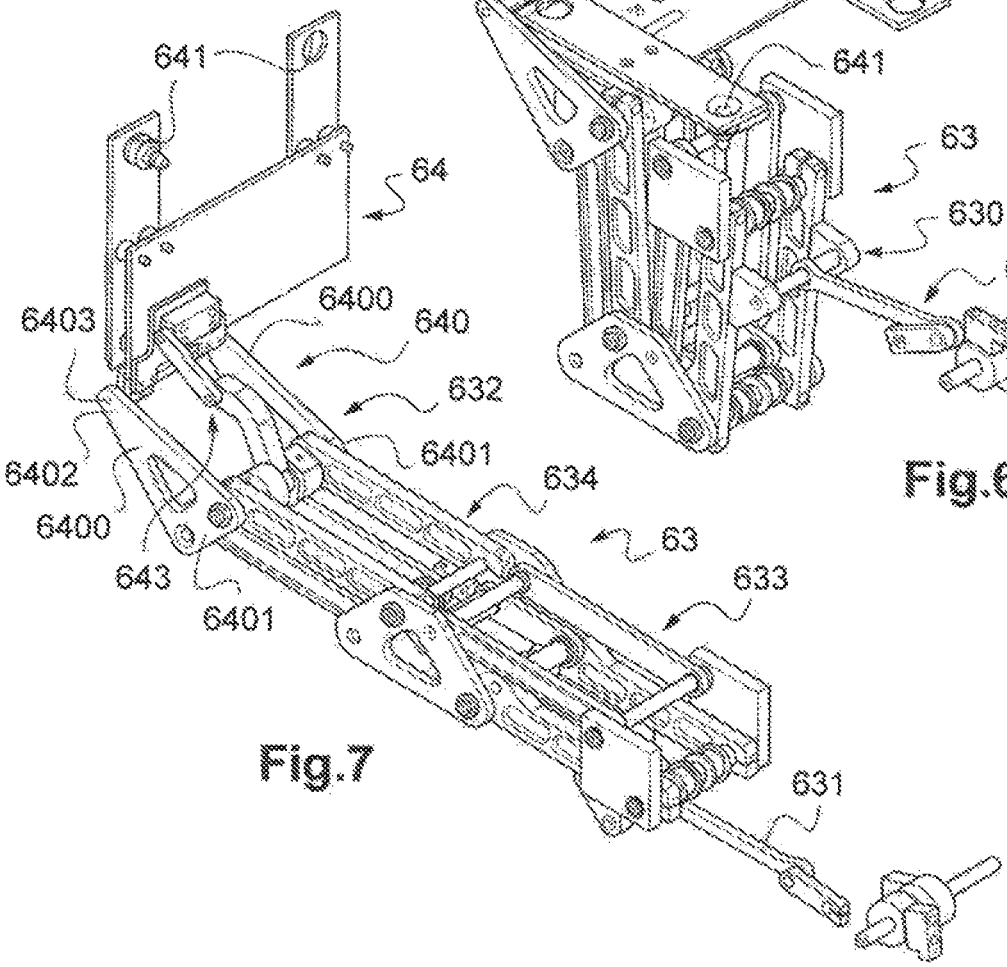
FIG. 7 is a view similar to FIG. 6, wherein the removal device is in deployed position.
Figure 2:
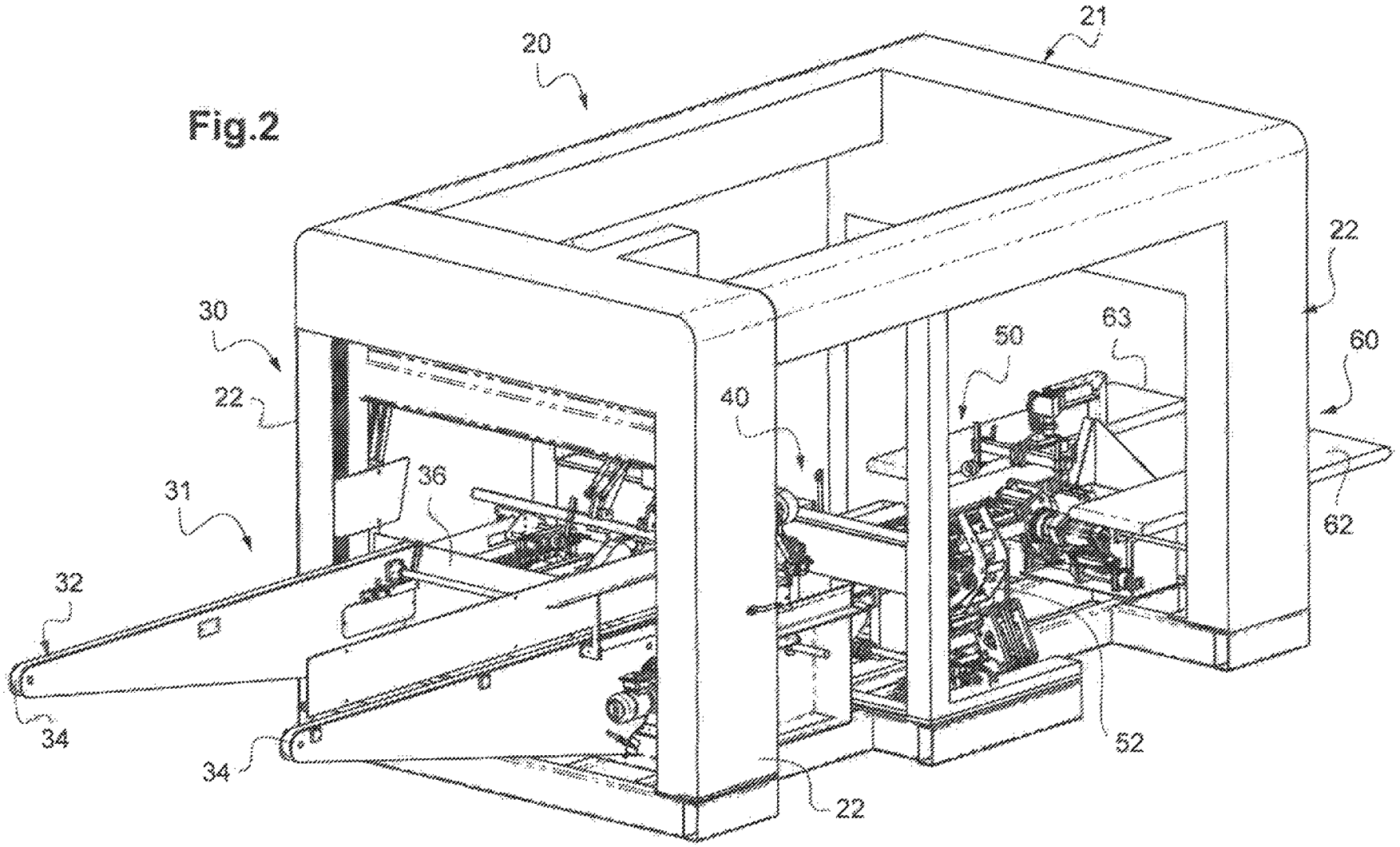
FIG. 2 is a perspective view of a machine for forming a box with a polygonal section, from the blank illustrated in FIG. 1, including a device for gluing according to the invention.
Figure 3:
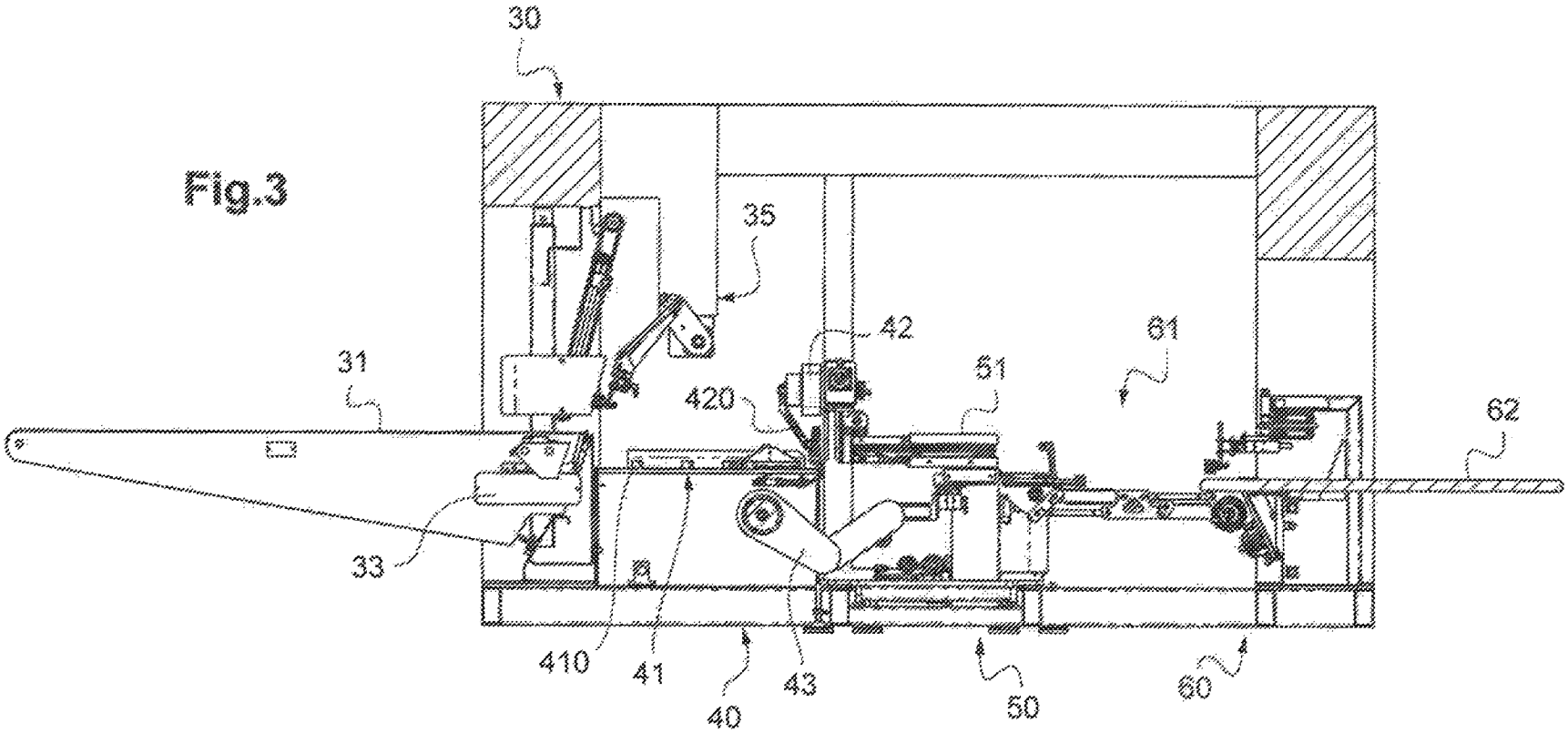
FIG. 3 is a longitudinal section side view of the machine illustrated in FIG. 2, more specifically of the right side of the machine in the direction for conveying the blanks.
Figure 4:
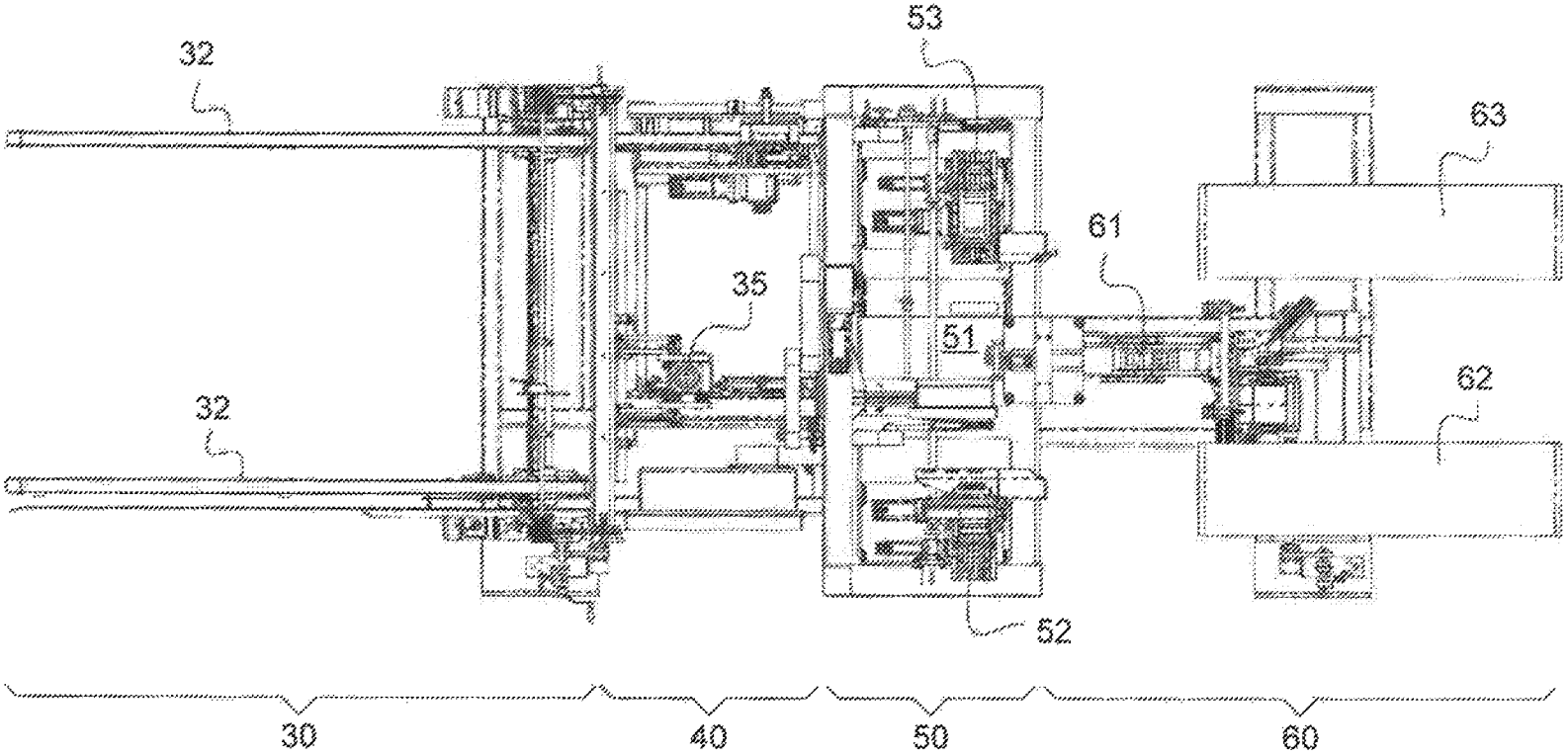
FIGS. 4 and 5 are top views of the machine illustrated in FIG. 2, FIG. 5 differing from FIG. 4 in that same also shows blanks being treated on the machine.
Figure 5:
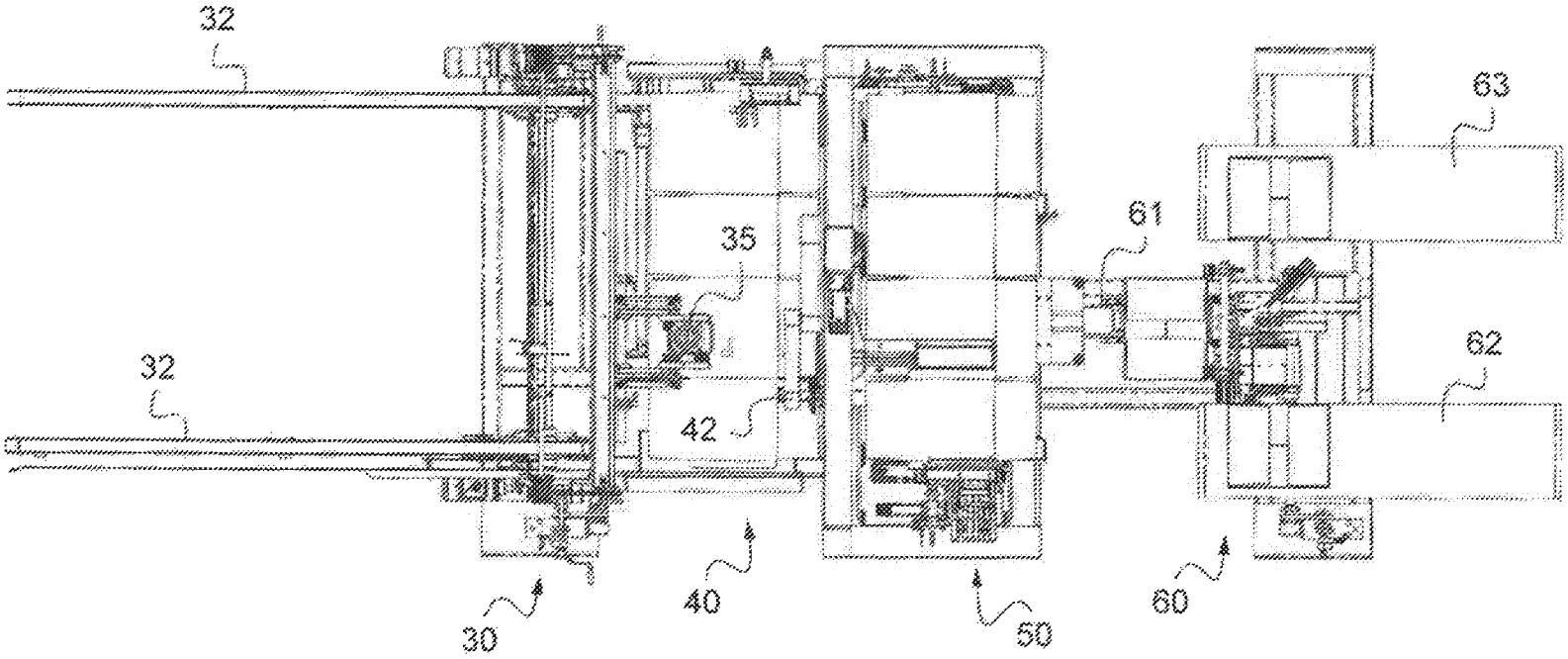

Said removal device is shown in folded position in FIG. 6 and in deployed position in FIG. 7.

It is of the cradle type and comprises an articulated arm system 63 as well as a plate 64.

The system 63 is, at one of the ends 630 thereof, rigidly connected to the frame 21 of the machine by suitable means 631.

Moreover, at the other end 632 thereof, the system 63 is rigidly connected to support means 640 for the plate 64.

In the example illustrated in the figures, said support means comprise two parallel parts 6400 attached, by one of the ends 6401 thereof, to the end 632 of the system 63.

The other ends 6402 of the support means 640 are connected by a common axis 6403, about which the plate 64 is mounted rotatable. The actuation of the plate is produced by means of the set of connecting rods 643.

The system 63 comprises two sets 633 and 634 of inter-articulated arms that can be controlled in a suitable manner so that the removal device 61 takes the folded position illustrated in FIG. 6 or the deployed position illustrated in FIG. 7.

The plate 64 is shown in flattened position in FIG. 6 and in upright position in FIG. 7.

Moreover, the plate 64 is provided with gripping means 641. Said gripping means comprise suction means. In particular, same may be gripping suction cups (illustrated in FIGS. 6 and 7) connected to a vacuum system known as per se. Said means are provided in order to be active on the upper face 642 of the plate 64, that is to say the face opposite the articulated arm system 63, in FIG. 6.

Reference is now made to FIGS. 8A to 8F to explain the various steps for operating the removal device illustrated in FIGS. 6 and 7.

In practice, the device 61 is designed to end the embodiment of the bottom of the box or box part, previously formed on the chuck 51. This is illustrated in FIGS. 8A to 8C.

Figure 8A:
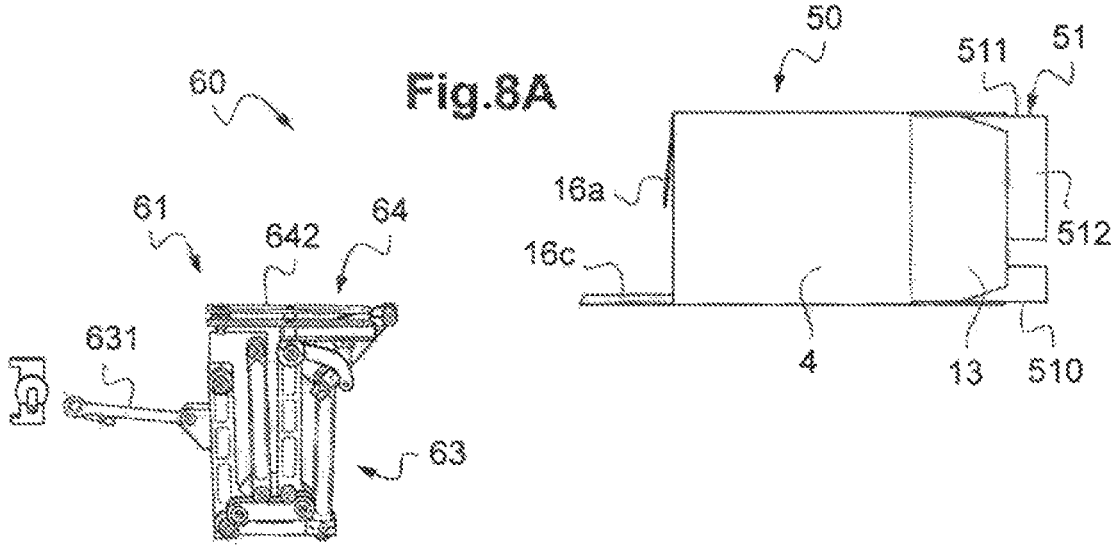
FIGS. 8A to 8F are side views illustrating the various steps for removing a box from the chuck.

Thus, FIG. 8A schematically illustrates the forming station 50, with the chuck 51.

Figure 8B:
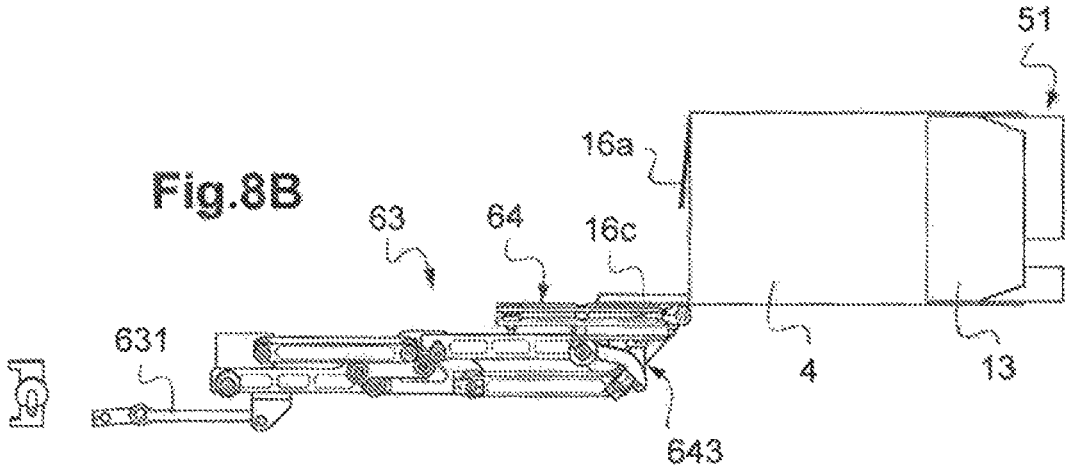
Figure 8C:
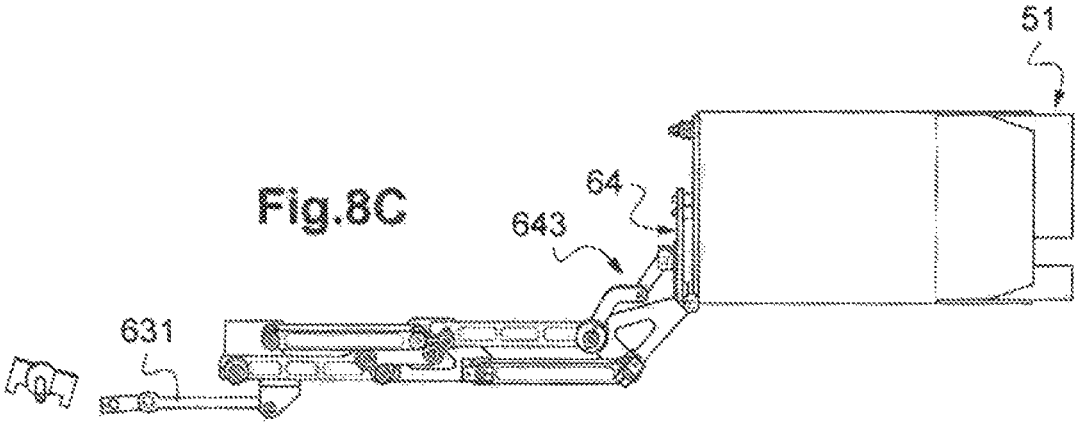
Figure 8D:
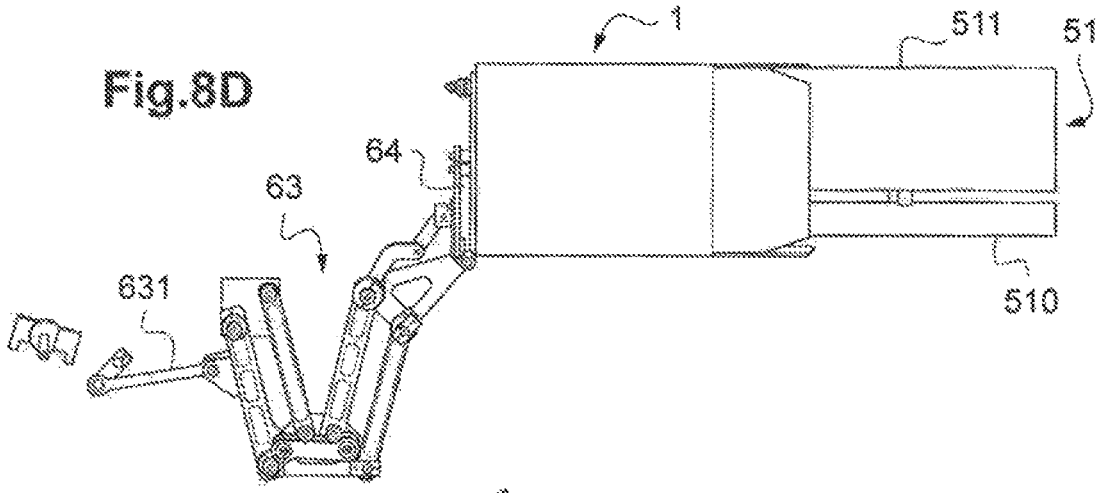
Figure 8E:
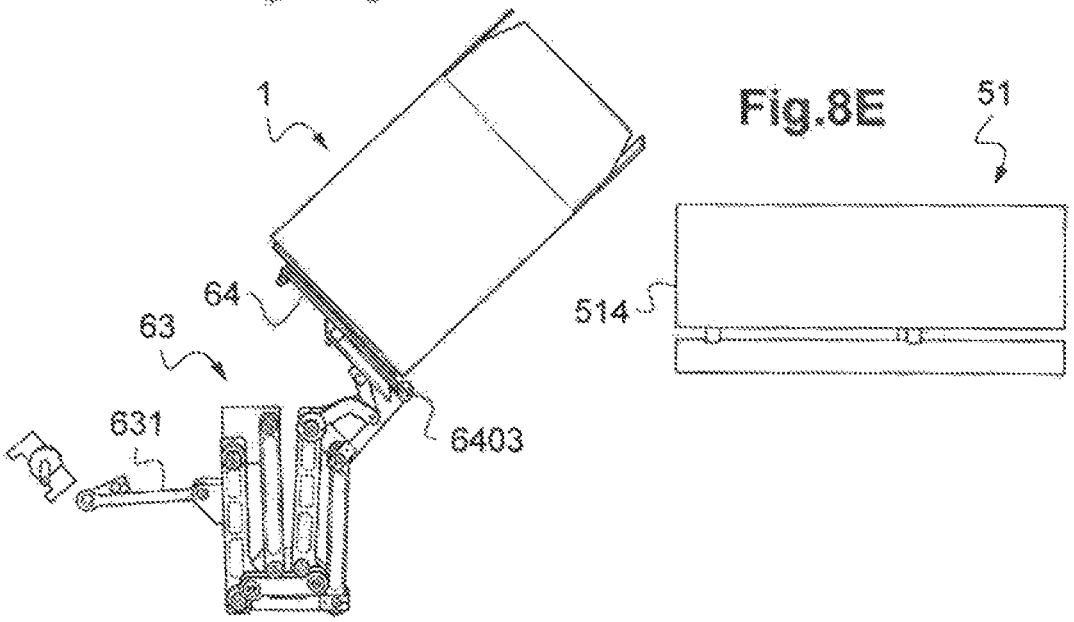
Figure 8F:
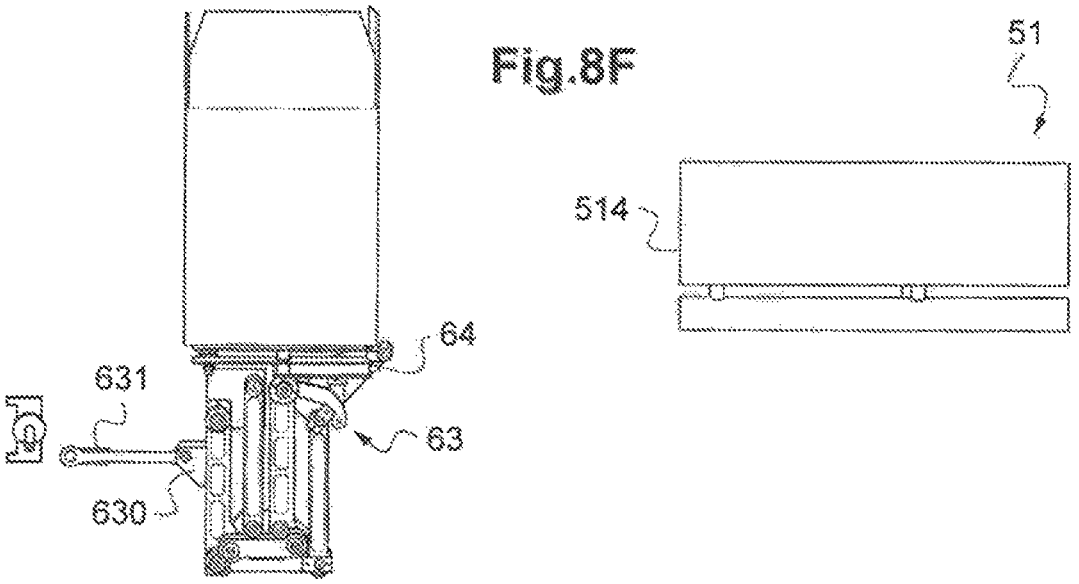

By comparing on one hand FIGS. 8A to 8C and on the other hand FIGS. 8D to 8F, it is understood that the chuck 51 is moveable between a forming position, illustrated in FIGS. 8A and 8C and a retracted position, illustrated in FIGS. 8D and 8F.

In the forming position illustrated in FIGS. 8A to 8C, the outer cross-section of the chuck corresponds to the inner cross-section of the box which will be obtained from the blank 1.

In the retracted position illustrated in FIGS. 8D to 8F, the distance between the application face 510 of the chuck and the opposite upper face 511 is smaller than the width of the box which will be obtained from the blank 1.

FIG. 8A illustrates the blank 1 after the forming thereof at the forming station 50.

Thus, the panel 5 is pressed against the application face 510, the panel 3, against the opposite face 511 and the panels 4 and 6 on the lateral faces. Only the lateral face 512 is illustrated in the figures.

Moreover, the panel 3 is attached on the tongue 7, the lateral flaps 16*b* and 16*d* are folded against the end face 514 of the chuck, as well as the flap 16*a*.

After the operations performed at the forming station, the blank is in the configuration illustrated in FIG. 8A, whereas the removal device 61 is in the position illustrated in FIG. 6. The plate 64 is therefore away from the chuck 51 and is in the flattened position thereof. FIG. 8A also shows that the plate 64 is therefore substantially parallel to the application face 510 of the chuck, the upper face 642 thereof being situated at a level lower than same of the application face 510.

In the next step illustrated in FIG. 8B, the articulated arm system 63 has been actuated so as to be deployed in the longitudinal direction of the machine or even in a direction substantially perpendicular to the end face 514 of the chuck, in the direction opposite to same of the movement of the blanks in the machine 21.

The removal device 61 and the chuck 51 are positioned in relation to one another, such that the plate 64 is located under the flap 16*c* in the deployed position of the removal device 6.

In the next step illustrated in FIG. 8C, the articulated arm system 63 remains in the deployed position thereof and the plate 64 is actuated so as to pass into the upright position thereof (illustrated in FIG. 7).

Said actuation is produced by means of the set of connecting rods 643.

The rotational motion of the plate 64 in the clockwise direction makes it possible to fold the flap 16*c* about the folding line 14 against the end face 514 of the chuck, and more specifically on the flaps 16*b* and 16*d* previously folded on said end face.

In said motion, the plate 64 also takes charge of the flap 16*a* previously folded against the flaps 16*b* and 16*d*.

Thus, it is the two flaps 16*a* and 16*c* that the plate 64 presses against the flaps 16*b* and 16*d*, by exerting a pressing force, to provide the attachment of the flaps, thanks to the lines of adhesive present on the upper face of the blank, at the level of flaps 16*a* and 16*c*.

Thus, after the step illustrated in FIG. 8C, the flaps 16*a* to 16*d* are attached together.

The gripping means 641 provided on the face 642 of the plate 64 are therefore activated to grip with the bottom of the box thus formed, by grasping same by suction.

FIG. 8D illustrates the next step wherein the chuck 1 is placed in a second retracted position, wherein the outer cross-section thereof is smaller than the inner cross-section of the box.

The pressure exerted by the plate 24 on the end face 514 is released and the articulated arm system 63 is actuated to initiate the folding thereof, still in a substantially longitudinal direction but, this time, in the direction of movement of the blanks within the machine 21.

In the next step illustrated in FIG. 8E, the articulated arm system 63 is practically in the folded position and the plate 24 performs a rotational motion in the anti-clockwise direction about the axis 6403.

Due to the activation of the gripping means, the box remains properly in contact with the plate 24.

FIG. 8F illustrates the position of the box and the removal device, after the removal process. Thus, the articulated arm system 63 and the plate 64 are in the position illustrated in FIG. 6, the system 63 being in folded position and the plate 64 in flattened position.

The box thus removed from the chuck may be deposited on one or other of the conveyors 62 or 63.

Figure 9:
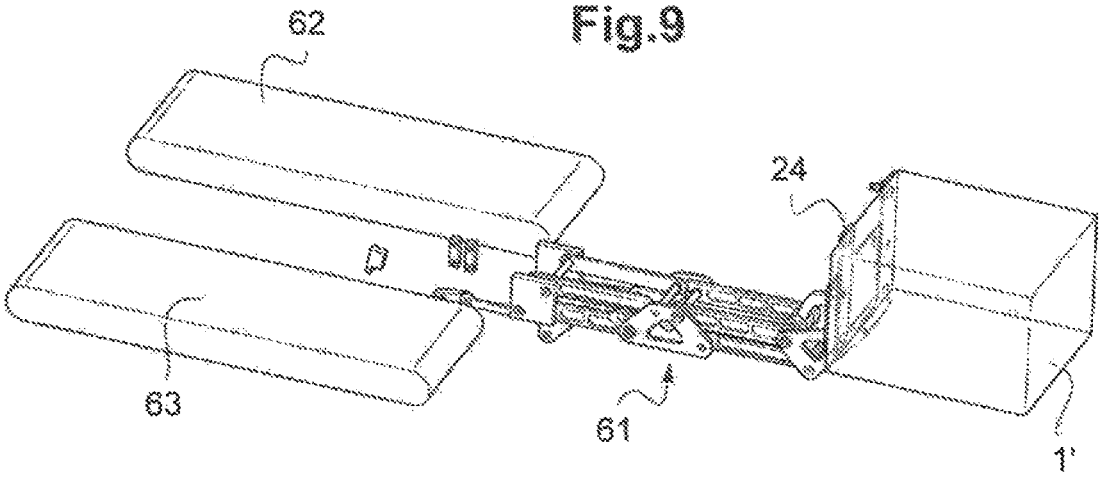
FIG. 9 is a perspective view illustrating the removal device in deployed position and with a box, corresponding to FIGS. 7 and 8C.
Figure 10:
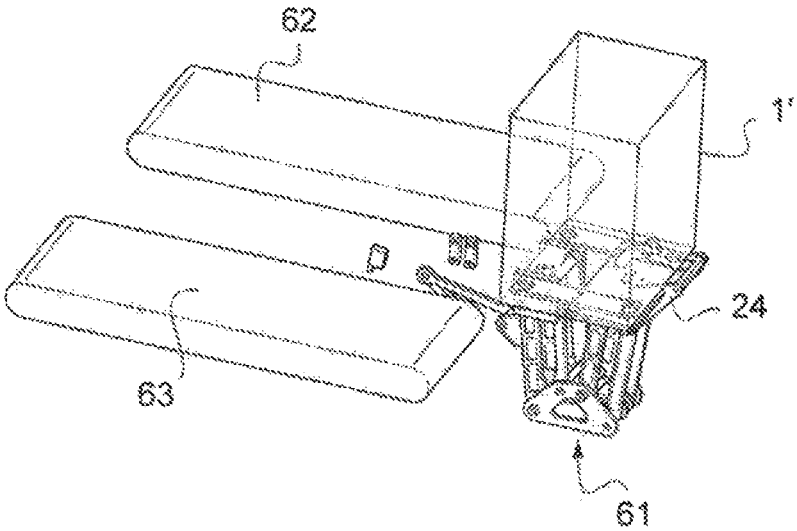
FIG. 10 is a perspective view illustrating the removal device in folded position and with a box, corresponding to FIGS. 6 and 8F.

FIGS. 9 and 10 illustrate the positioning of the removal device 61, in relation to the conveyors 62 and 63.

As illustrated in FIGS. 2 to 5, said two conveyors extend longitudinally, that is to say in the direction of movement of the blanks in the machine.

The removal device is positioned at the front of the conveyors 62 or 63, or even between said conveyors and the chuck 51, and between the two conveyors.

FIG. 9 illustrates the removal device 61 and the two conveyors 62, 63 whereas the removal device 61 is in the position illustrated in FIGS. 7 and 8C, a box 1' in lying position being gripped with the plate 24.

FIG. 10 illustrates for its part the removal device in the position illustrated in FIGS. 6 and 8F, a box 1' being present upright on the plate 24 in flattened position.

Reference is now made to FIGS. 11A to 11G to describe an example of implementation of the transfer on a conveyor of a box 1' removed from the chuck 51 and present on the removal device 61, in the position illustrated in FIG. 10.

Said transfer is herein produced by means of a device 65 comprising an arm 550 rotatable about a fixed axis 651 in relation to the frame 21 and substantially vertical, that is to say substantially perpendicular to the table 41 or even to the application face 510 of the chuck.

Said axis of rotation 651 extends between the two conveyors 62 and 63, only said latter being illustrated in FIGS. 11A to 11G.

The device 65 supports, at the end of the arm 650 opposite the axis 651, a plate 652 provided with gripping means 653.

Figure 11E:
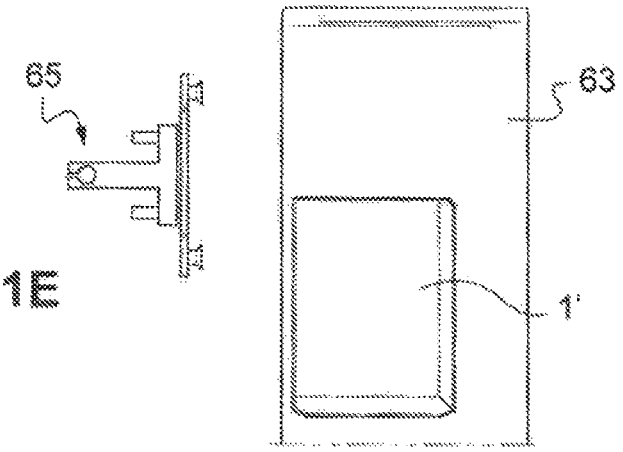

As shown in FIGS. 11A and 11E to 11G on one hand and FIGS. 11B to 11D on the other hand, said plate 652 is moveable between a retracted position, illustrated for example in FIG. 11A and a deployed position, illustrated for example in FIG. 11B.

Therefore, FIG. 11A illustrates the box 1' on the removal device 61. The box is open and rests by the bottom thereof on the plate 64 of the removal device.

The plate 652 of the removal device 65 is therefore opposite a lateral face of the box.

FIG. 11B illustrates the next step wherein the device 65 is passed into the deployed position thereof. The gripping means 652 are therefore in contact with the lateral face of the box 1'. Same are actuated so as to grasp the box.

In the next step illustrated in FIG. 11C, the device 65 initiates a rotational motion about the axis 651 and in the clockwise direction.

In the position thereof illustrated in FIG. 11D, the device 65 has completed the 90° rotational motion thereof and the box 1' is therefore still in contact with or slightly above the conveyor 63. The gripping means 652 are therefore deactivated.

In the next step illustrated in FIG. 11E, the device 65 is passed into the folded position thereof and the box 1' is evacuated by the conveyor 63.

Figure 11F:
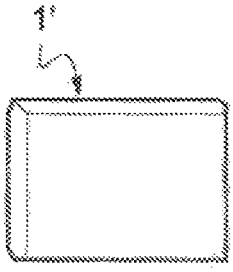

As shown in FIG. 11F, whereas the box 1' continues the motion thereof on the conveyor 63, the device 65 rotates about the axis 651 and in the anti-clockwise direction. At that moment, a new box 1' has been removed from the chuck 51 by the removal device 61 and is located on said latter in the position illustrated in FIG. 10.

Figure 11G:
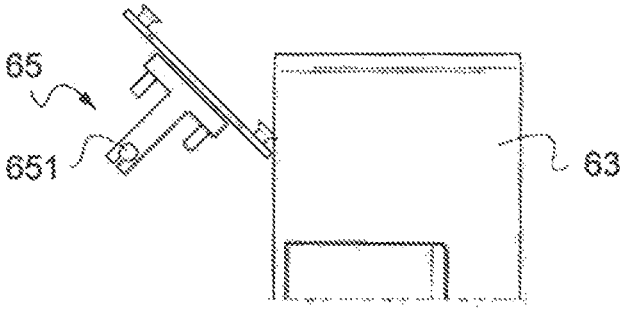
Figure 11G:
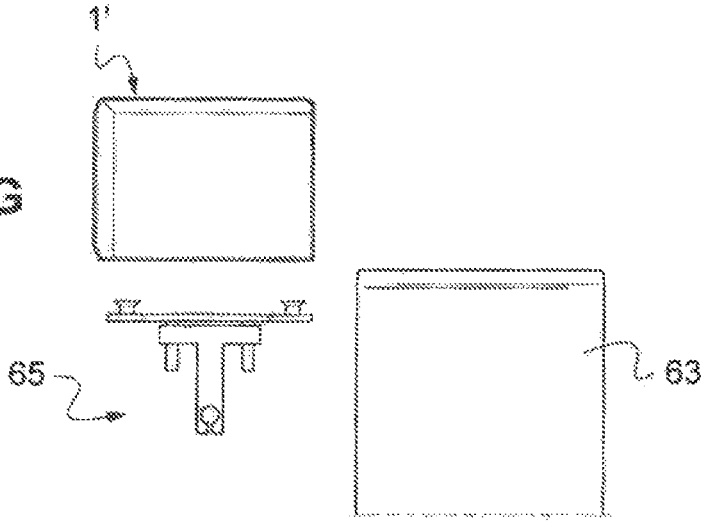

FIG. 11G illustrates the end of the 90° rotational motion of the device 65 which regains the position illustrated in FIG. 11A, in order to perform a new cycle for transferring a box 1' on the conveyor 63.

However, the invention is not limited to said mode of implementation. In particular, the removal device 61 could be designed so that the articulated arm system 63 is rotatable about a vertical axis passing through the first end 630 thereof.

Thus, after the step illustrated in FIG. 8F, the removal device being in folded position, same could rotate 90° about said vertical axis. The box 1' would therefore be located opposite an end of the conveyor 63. Additional means would therefore be provided in order to produce the transfer thereof on the conveyor 63.

It follows from the foregoing that the removal device according to the invention makes it possible to pass the box from a lying position to an upright position, the face still open of the box therefore being upwardly directed. The box is in a stable position when it is upright since same is permanently held by the removal device during the tipping thereof.

Moreover, the engagement of said removal device 61 with the transfer means, such as the device 65, makes it possible to deposit the box on the conveyor, always stably. Indeed, said transfer means, such as the removal device 61, comprise gripping means, in particular by suction.

Thus, the invention avoids the drawbacks of the devices and methods known in prior art by permanently maintaining contact between the box and the gripping means, up to the deposit of the box on the conveyor. This helps to increase the rates that may be reached with the machine 20.

The operation of the machine for forming a box will now be described with reference to the figures.

From the magazine 31 for storing blanks, a first blank 1 is removed, same is tipped horizontally.

Same is therefore dropped on the table 41 and same is accurately positioned on the table 41.

The blank being immobile, lines of adhesive are deposited on at least two lateral flaps 16*c* and 16*a*, on the upper face of the blank, the inner face constituting the printed face of the blank.

The blank is subsequently transferred from the gluing station to the forming station and during said transfer a line of adhesive is deposited near the free edge of the flap 3 or on the tongue 7.

The blank 1 being positioned under the chuck, the winding thereof about the chuck is performed, herein by means of two cradles 52 and 53. However, said forming may be produced by any means.

After the forming step, the panel 3 is glued on the tongue 7 and the lateral flaps 16*a* are 16*c* are glued on the flaps 16*b* and 16*d* to form the bottom of the box on the end face 510 of the chuck. Said latter is turned towards the removal module 60.

In one embodiment, after the forming step, the flaps are not mutually attached, only the flaps 16*a*, 16*b* and 16*d* being folded.

Therefore, it is the removal device that carries out the refolding of the flap 16*c* and the mutual attachment of the flaps, as illustrated in FIGS. 8A to 8C.

The device 61 therefore removes the box thus formed from the chuck 51, as has been described with reference to FIGS. 8D to 8F, the box subsequently being deposited on one or the other of the conveyors 62 or 63, for example as illustrated in FIGS. 11A to 11G.

The preceding description also applies to the formation and removal of a box part.

Of course, said method is implemented within the context of a successive and automatic forming of boxes or box parts, such that blank n is glued during the forming of blank n−1.

As goes without saying and as also results from the foregoing, the present invention is not limited to particular embodiments described. On the contrary, it encompasses all embodiments and in particular those where the chuck has eight sides and/or those where the flaps forming the bottom are folded down on the chuck by additional means.

The invention claimed is:

1. A device for removing a box or box part with a polygonal section from a chuck comprising an upper face, an application face interconnected by lateral faces and an end face, the chuck whereon the box has been previously formed from a blank comprising a series of at least three panels, said panels being interconnected by parallel folding lines and provided with lateral flaps, respectively connected to said panels by folding lines perpendicular to the folding lines connecting said panels, wherein said device comprises a plate comprising first gripping means and translatably moveable between a deployed position wherein the plate is near the end face of the chuck whereon the lateral flaps are intended to be folded and a folded position wherein the plate is away from the chuck and in that the chuck itself is moveable between a first forming position wherein a outer cross-section of the chuck corresponds to an inner cross-section of the box or box part and a second retracted position wherein the outer cross-section thereof is smaller than the inner cross-section of the box or box part, wherein the first gripping means comprise suction means.

2. The device according to claim 1, further comprising an articulated arm system configured to be deployed in a direction substantially perpendicular to said end face of the chuck and a first end of which is rigidly connected to a frame of the device and a second end of which supports said plate.

3. The device according to claim 1, wherein said plate is rotatable between a flattened position wherein said plate is substantially parallel to the application face of the chuck and an upright position wherein said plate is substantially parallel to said end face.

4. The device according to claim 1, wherein when the chuck is in the first retracted position thereof, a distance between the upper face and the application face of the chuck is arranged to be smaller than a width of the box or box part.

5. The device according to claim 1, wherein an articulated arm system is rotatable about a vertical axis passing through the first end thereof rigidly connected to a frame.

6. The device according to claim 1, wherein said series of at least three panels comprises two end panels on either side of at least one intermediate panel.

7. A machine for forming a box or box part with a polygonal section from a blank comprising a series of at least three panels, said panels being interconnected by parallel folding lines and provided with lateral flaps, respectively connected to said panels by folding lines perpendicular to the folding lines connecting said panels, comprising:

- a gluing station wherein an adhesive is deposited on at least two lateral flaps,
- a forming station wherein the panels are wound about a chuck and flaps being located on the same side of said panels are folded, and
- a removal station comprising a device, wherein said device comprises a plate comprising first gripping means and translatably moveable between a deployed position wherein the plate is near an end face of the chuck whereon the lateral flaps are intended to be folded and a folded position wherein the plate is away from the chuck and in that the chuck itself is moveable between a first forming position wherein the outer cross-section of the chuck corresponds to the inner cross-section of the box or box part and a second retracted position wherein the outer cross-section thereof is smaller than the inner cross-section of the box or box part, wherein the first gripping means comprise suction means.

8. The machine according to claim 7, further comprising a transfer station to at least one evacuation station.

9. The machine according to claim 8, wherein the transfer station comprises second gripping means for gripping the box or box part present at the removal station, said second means being rotatable between a first position wherein same are opposite the removal station and a second position wherein same are opposite the evacuation station, said second gripping means also being translatably moveable between a deployed position wherein same are intended to be in contact with the box or box part and a retracted position of rest.

10. The machine according to claim 9, wherein the second gripping means comprise suction means.

11. The machine according to claim 7, wherein the removal station comprises gripping means translatably moveable between a retracted position and a deployed position, and said device comprises an articulated arm system rotatable about a vertical axis passing through the first end thereof rigidly connected to a frame.

12. The device according to claim 7, wherein said series of at least three panels comprises two end panels on either side of at least one intermediate panel.

* * * * *